US008142077B2

(12) United States Patent
Iannelli, II et al.

(10) Patent No.: US 8,142,077 B2
(45) Date of Patent: Mar. 27, 2012

(54) BAG STRUCTURES AND METHODS OF ASSEMBLING THE SAME

(75) Inventors: Michael Louis Iannelli, II, Thompsons Station, TN (US); Gary Alan Fulk, Milton, FL (US); Robert G. Owens, Kansas City, MO (US); Jason L. Raines, Oxford, IN (US)

(73) Assignee: Graphic Packaging International, Inc., Marietta, GA (US)

( * ) Notice: Subject to any disclaimer, the term of this patent is extended or adjusted under 35 U.S.C. 154(b) by 391 days.

(21) Appl. No.: 12/424,188

(22) Filed: Apr. 15, 2009

(65) Prior Publication Data

US 2009/0263049 A1 Oct. 22, 2009

Related U.S. Application Data

(60) Provisional application No. 61/045,490, filed on Apr. 16, 2008.

(51) Int. Cl.

| | |
|---|---|
| ***B65D 33/16*** | (2006.01) |
| ***B65D 30/20*** | (2006.01) |
| ***B65D 33/00*** | (2006.01) |
| ***B65D 33/30*** | (2006.01) |

(52) U.S. Cl. ..... 383/64; 383/120; 383/210; 383/210.1; 383/211; 383/88; 383/89; 383/205; 383/203; 383/61.2

(58) Field of Classification Search ..... 383/64, 383/120, 61.2, 88, 89, 203, 204, 205, 210, 383/210.1, 211

See application file for complete search history.

(56) References Cited

U.S. PATENT DOCUMENTS

| | | | |
|---|---|---|---|
| 2,189,847 | A | 2/1940 | Verwys |
| 2,517,801 | A | 8/1950 | Roush |
| 3,065,899 | A | 11/1962 | Means et al. |
| 3,130,897 | A | 4/1964 | Poklukar et al. |
| 3,146,564 | A | 9/1964 | Hopkins |
| 3,261,267 | A | 7/1966 | Becker |
| 3,397,622 | A | 8/1968 | Goodwin |

(Continued)

FOREIGN PATENT DOCUMENTS

| | | | |
|---|---|---|---|
| EP | 0498047 | A1 | 8/1992 |

(Continued)

OTHER PUBLICATIONS

Fuller, H.B., Water Responsive Hot Melts: The Premium Repulpable Hot Melt for the Paper and Multi-Wall Bag Industry, Powerpoint Presentation, 15 pages.

(Continued)

*Primary Examiner* — Jes F Pascua
(74) *Attorney, Agent, or Firm* — Womble Carlyle Sandridge & Rice, LLP

(57) ABSTRACT

A bag structure includes, in an example embodiment, a bag body including side walls having inner and outer surfaces, and the bag body further includes a top end and a bottom end. A closure member is coupled to the top end for opening and closing the bag body. A sealing material is applied to an area proximate at least one of a top edge of the side walls and a bottom edge of a portion of the closure member. An adhesive member is secured to the bag body. The adhesive member includes a reinforced section and an adhesive section. The adhesive member is configured to retain the top end of the bag body in a folded over relationship until the adhesive member is severed along the reinforced section.

19 Claims, 8 Drawing Sheets

U.S. PATENT DOCUMENTS 3,482,762 A 12/1969 Jones
3,810,813 A 5/1974 Ellis
3,894,682 A 7/1975 Harmsen
4,091,986 A 5/1978 Eberle
4,095,736 A 6/1978 Rothschild, III et al.
4,166,482 A 9/1979 Sanders
4,241,865 A * 12/1980 Ferrell ..... 383/204
4,335,817 A * 6/1982 Bahr ..... 383/204
4,337,889 A * 7/1982 Moertel ..... 383/210.1
4,344,558 A 8/1982 Newton et al.
4,367,620 A 1/1983 Fox
4,391,404 A 7/1983 Welter
4,401,140 A 8/1983 Vogel
4,453,270 A 6/1984 Donini et al.
4,471,875 A 9/1984 Hain et al.
4,576,844 A 3/1986 Murray et al.
4,620,320 A 10/1986 Sullivan
4,637,063 A * 1/1987 Sullivan et al. ..... 383/61.3
4,681,781 A 7/1987 Murray et al.
4,691,370 A * 9/1987 MacFee ..... 383/61.3
4,759,640 A 7/1988 Groner
4,759,641 A 7/1988 Jacobs
4,824,261 A 4/1989 Provost
4,902,142 A 2/1990 Lammert et al.
4,930,904 A 6/1990 Groner et al.
4,955,981 A 9/1990 Provost
4,982,873 A 1/1991 Kelley et al.
5,048,692 A 9/1991 Handler et al.
5,098,201 A 3/1992 Jacobi
5,158,370 A 10/1992 Jacobi
5,405,198 A 4/1995 Garrett
5,516,210 A 5/1996 Kelley et al.
5,620,542 A 4/1997 Avila et al.
5,725,312 A 3/1998 May
5,788,378 A 8/1998 Thomas
5,797,683 A 8/1998 Gunzi et al.
5,806,982 A 9/1998 Kelley et al.
5,816,709 A 10/1998 Demus
5,863,979 A 1/1999 Ahmed
5,938,337 A 8/1999 Provan et al.
5,964,532 A 10/1999 St. Phillips et al.
5,967,664 A 10/1999 Giles et al.
6,013,018 A 1/2000 Bannister
6,074,095 A 6/2000 Bannister et al.
6,092,930 A 7/2000 Kelley et al.
6,120,184 A 9/2000 Laurence et al.
6,126,316 A 10/2000 Bannister
6,148,588 A 11/2000 Thomas et al.
6,164,823 A 12/2000 Donnell
6,273,607 B1 8/2001 Buchman
6,279,298 B1 8/2001 Thomas et al.
6,286,999 B1 9/2001 Cappel et al.
6,290,390 B1 9/2001 Buchman
6,290,391 B1 9/2001 Buchman
6,328,471 B1 12/2001 Culbertson
6,328,472 B1 12/2001 Laurence et al.
6,347,437 B2 2/2002 Provan et al.
6,347,885 B1 2/2002 Buchman
6,354,739 B1 3/2002 Sheehan, Jr. et al.
6,361,209 B1 3/2002 LaRue et al.
6,427,421 B1 8/2002 Belmont et al.
6,439,770 B2 8/2002 Catchman
6,467,956 B1 10/2002 Tilman et al.
6,471,403 B1 10/2002 Janssen
6,474,866 B2 11/2002 Buchman
6,499,878 B1 12/2002 Dobreski et al.
6,499,879 B2 12/2002 Schneck
6,572,266 B2 6/2003 Buchman
6,575,625 B2 6/2003 Cappel et al.
6,595,688 B2 7/2003 Schneck
6,609,828 B2 8/2003 Schneider et al.
6,663,283 B1 12/2003 Cappel
6,712,509 B2 3/2004 Cappel
6,719,140 B1 4/2004 Rinsler
6,748,723 B2 6/2004 Wadium et al.
6,802,879 B2 10/2004 Scanlon
6,805,485 B2 10/2004 Hogan et al.
6,846,107 B2 1/2005 Sweeney et al.
6,866,420 B2 3/2005 Buchman
6,969,195 B2 11/2005 Ferranda
6,974,256 B2 12/2005 Kinigakis et al.
6,979,482 B2 * 12/2005 Hartzell et al. ..... 428/34.3
7,090,904 B2 * 8/2006 Hartzell et al. ..... 428/34.3
7,166,344 B2 1/2007 Dean
7,192,191 B2 * 3/2007 Wedi et al. ..... 383/64
7,204,641 B2 * 4/2007 Stolmeier ..... 383/64
D580,779 S 11/2008 Hartwell et al.
7,819,583 B2 * 10/2010 Walker et al. ..... 383/61.2
2001/0014186 A1 8/2001 Randall
2002/0164091 A1 11/2002 Schneck
2002/0196987 A1 12/2002 Tilman et al.
2003/0035598 A1 2/2003 Hiraiwa et al.
2003/0138168 A1 7/2003 Petit
2004/0014579 A1 1/2004 Sweeney et al.
2004/0091648 A1 5/2004 Hartzell et al.
2004/0114838 A1 6/2004 McGregor
2004/0223665 A1 11/2004 Blohowiak et al.
2004/0228547 A1 11/2004 Hartzell et al.
2005/0047686 A1 3/2005 Elsaesser
2005/0111765 A1 5/2005 Beaulieu
2006/0035777 A1 2/2006 Johnson
2006/0072859 A1 4/2006 Melchoir et al.
2006/0189468 A1 8/2006 DeMatteis et al.
2006/0228055 A1 10/2006 Eads et al.
2007/0065051 A1 3/2007 Eads et al.
2007/0104397 A1 5/2007 Walker et al.
2008/0050052 A1 2/2008 Anzini et al.
2008/0118191 A1 5/2008 Garger
2008/0267539 A1 10/2008 Howell et al.
2008/0279484 A1 * 11/2008 Greco et al. ..... 383/63
2009/0052812 A1 * 2/2009 Plourde et al. ..... 383/64
2009/0097783 A1 4/2009 Anzini et al.
2009/0226121 A1 9/2009 Veder
2009/0263048 A1 10/2009 Iannelli, Ii et al.
2010/0247001 A1 * 9/2010 Sargin ..... 383/64
2010/0284633 A1 11/2010 Dytchkowskyj et al.

FOREIGN PATENT DOCUMENTS

EP 0525337 A1 2/1993
EP 0815024 A1 1/1998
EP 1132311 A2 9/2001
JP 2004-277012 A 10/2004
JP 3132904 U 6/2007
NL 8005060 A 3/1981
WO WO-8808816 A1 11/1988
WO WO-0064768 A1 11/2000
WO WO 2006/037240 A1 4/2006

OTHER PUBLICATIONS

International Search Report and Written Opinion from corresponding International Application No. PCT/US2009/040780.

* cited by examiner

BAG STRUCTURES AND METHODS OF ASSEMBLING THE SAME

REFERENCE TO RELATED APPLICATION

The benefit of the filing date of U.S. provisional patent application Ser. No. 61/045,490 filed on 16 Apr. 2008 is hereby claimed and the provisional application is hereby incorporated by reference.

TECHNICAL FIELD

This invention relates generally to bag structures, and more particularly, to bag structures having improved loading, tamper evident, and sealing features.

BACKGROUND

At least some known bag structures are fabricated from a single ply of material or from multiple plies or layers. The bag structures may be fabricated from paper or plastic materials. Typically, multiwall bags are fabricated as tubes formed from a plurality of paper plies. In addition to having paper plies, one or more plies, typically the innermost one or more plies, may be fabricated from a thin plastic material, or may be coated with a resinous material, to provide a degree of moisture resistance to the finished bag.

Closure of the multiwall bag structures typically is accomplished by applying adhesive (e.g., hot melt or sonically activatable adhesive) to the outer surface of the bag and folding over the top end. Closing the bag by simply folding and adhesively affixing the flap provides a pointed, pinch bottom closure. The opposite end of the bag may be likewise provided with a pinch bottom closure, or it may be closed and sealed in a different configuration, such as a diamond or rectangular configuration, so that the pinch "bottom" may actually be the top of the bag, as may be found commonly in bags containing dry granular material, like dog food, cat litter, or fertilizer. When such a bag is closed and sealed, the folded over closure is typically quite strong, and requires cutting of the bag plies below the folded over and sealed closure in order to gain access to the contents of the bag. Moreover, once such bags are opened, the bags cannot be reclosed or resealed. As such, the contents of the bag may spoil quickly and are susceptible to spillage through the opening or the entering of small pests through the opening.

In order to facilitate opening and closing of bag structures, such as flexible bags, some bag structures are known that incorporate a zipper that may be opened and closed. At least some of these known bag structures also include a slider to aide in opening and closing of the zipper. However, these known bag structures are typically included on flexible bags and bags that are top loaded. When a bag is top loaded, the product loaded into the bag does not contact the zipper during loading. As a result, the zipper is protected from any impact of loading the product into the bag. However, other known bag structures are bottom loaded, such as bags loaded with dry granular material, like dog food, cat litter, or fertilizer. Because these bags are bottom loaded, the zipper at the mouth of the bag is susceptible to damage or rupture during loading of the product into the bag.

In addition, bags having gusseted sides with an opening and closing zipper attached to the top of the bag are oftentimes plagued with ingress channels or openings that allow small pests or insects to enter the bag and contaminate the contents thereof. Accordingly, it would be beneficial to provide a bag having gusseted side walls and an opening and closing zipper that includes sealed areas that facilitate reducing such ingress channels. It would also be beneficial to provide a bag having an opening and closing zipper that is bottom loaded that provides protection against damage to the zipper from loading, and provides tamper resistance.

SUMMARY

Briefly described, a bag structure is provided including a bag body, a closure member, a sealing material, and an adhesive member. The bag body includes side walls having inner and outer surfaces, and the bag body further includes a top end and a bottom end. The closure member is coupled to the top end for opening and closing the bag body. The sealing material is applied to an area proximate at least one of a top edge of the side walls and a bottom edge of a portion of the closure member. The adhesive member includes a reinforced section and an adhesive section. The adhesive member is configured to retain the top end of the bag body in a folded over relationship until the adhesive member is severed along the reinforced section.

In another aspect, a slider bag is provided including a bag body having a front wall, a rear wall, and side walls extending therebetween. The bag body has a top end and a bottom end, wherein the front, rear, and side walls extend between the top end and the bottom end. A zipper member is coupled to the front and rear walls at the top end of the bag body. The zipper member extends substantially an entire length of the bag body. A slider clip is coupled to the zipper member for opening and closing the zipper member. A sealing material is applied to an area proximate at least one of a top edge of the side walls and a bottom edge of a portion of the zipper member. An adhesive member extends along the zipper member. The adhesive member includes an adhesive section configured to secure the adhesive member to the bag body and a reinforced section extending substantially an entire length of the adhesive member. The adhesive member is secured to the bag body proximate the top end and is configured to retain the top end of the bag body in a folded over position until the adhesive member is severed.

In a further aspect, a method of assembling a bag structure is provided. The bag structure includes front, rear, and side walls extending between top and bottom ends of the bag structure. The bag structure also includes a zipper member, a slider clip, and an adhesive member having an adhesive section and a reinforced section. The method includes attaching the zipper member to the top end of the bag structure, and attaching the slider clip to the zipper member, wherein the slider clip is configured to open and close the zipper member. The method further includes applying a sealing material to an area proximate at least one of a top edge of the side walls and a bottom edge of a portion of the zipper member. The method further includes folding over the top end of the bag structure along a fold line to define a top flap, and securing the top flap to an outer surface of the bag structure using the adhesive member, wherein the top flap is released upon severing the adhesive member at the reinforced section.

DETAILED DESCRIPTION

Figure 1:
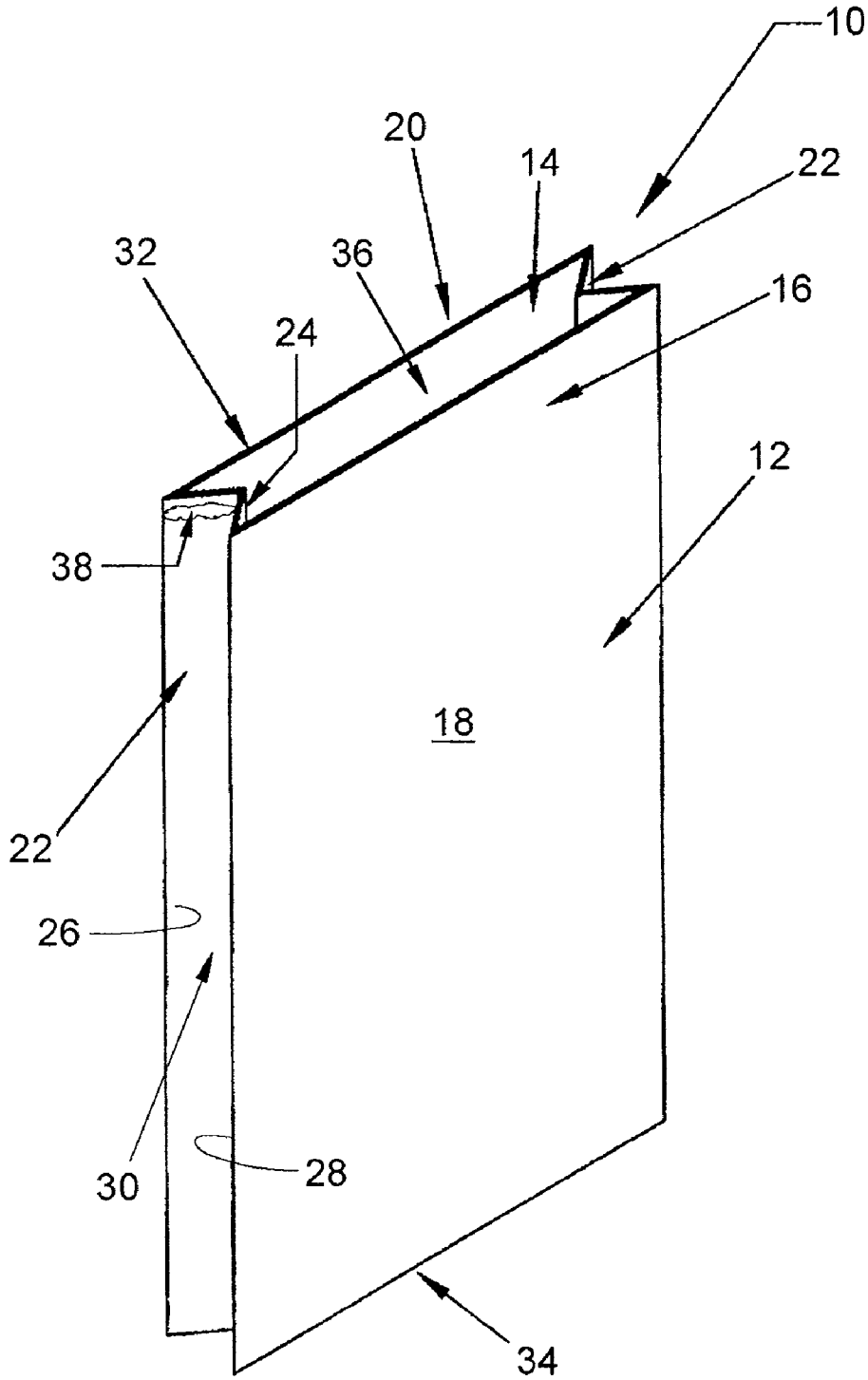
FIG. 1 is a side perspective view of a multiwall bag in an open position in accordance with the present invention.

FIG. 1 is a side perspective view of a bag 10 in an open position. In an example embodiment, bag 10 is constructed with a tubular body 12 formed from multiple layers or plies of material. For example, an inner layer 14 of bag 10 is a polymeric material and an outer layer 16 of bag 10 is a paper material. In the example embodiment, bag 10 includes an inner plastic layer adhered to an inner paper member, and an outer paper member adhered to or otherwise secured to the inner paper member. However, bag 10 may include multiple layers of polymeric and/or paper materials along the inner or outer portions of bag 10. Alternatively, bag 10 is constructed of a single layer of paper or plastic material.

Bag 10 includes a front wall 18, a rear wall 20, and side walls 22. Side walls 22 are gusseted along center fold line 24 to form a first gusset panel 26 and a second gusset panel 28. When bag 10 is at least partially erected, a channel 30 is formed between front and rear walls 18 and 20. Bag 10 also includes a top end or mouth 32 and a bottom end 34. When formed, each of top and bottom ends 32 and 34 are open to a cavity 36. Cavity 36 is configured to receive a product (not shown). In the example embodiment, bag 10 is bottom loaded such that the product is filled into cavity 36 through bottom end 34, and then bottom end 34 is sealed or otherwise closed.

To seal the upper end of bag 10, and as discussed in more detail below, a sealing material 38 is applied to an area proximate to at least a top edge of an outer surface of first gusset panel 26. In another embodiment, sealing material 38 is applied to an area proximate to a top edge of both panels 26 and 28. Applying the sealing material in this manner allows for channel 30 to be sealed when bag 10 is in a closed position. In the example embodiment, sealing material 38 may include, but is not limited to, an adhesive material, such as a hot melt adhesive, a caulking material, a foam material, an expandable sealing material, or a resealable material.

Figure 2:
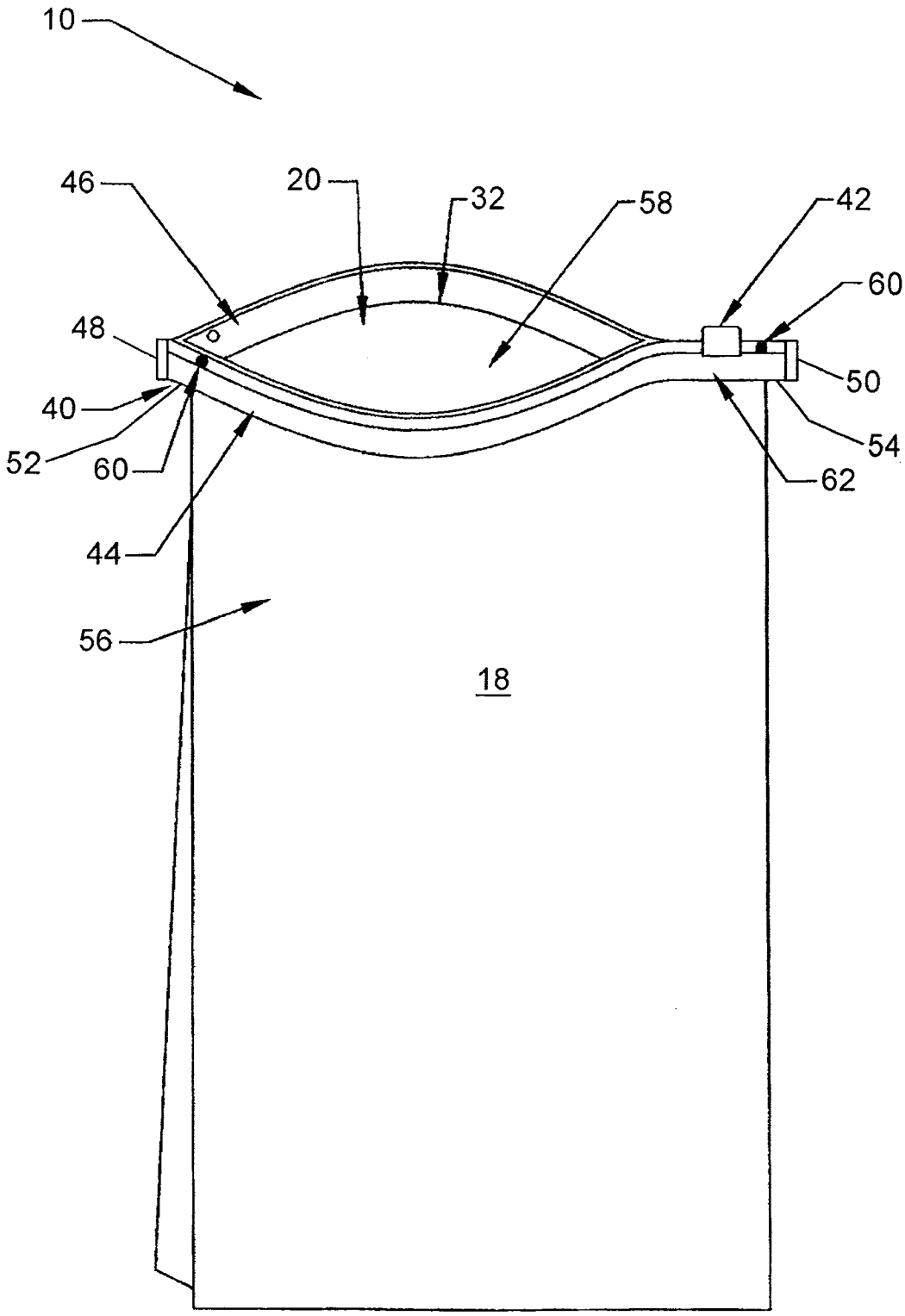
FIG. 2 is a side perspective view of the multiwall bag shown in FIG. 1 with a zipper member and slider clip attached thereto.

FIG. 2 is a side perspective view of bag 10 with a zipper member 40 and slider clip 42 attached thereto. Zipper member 40 includes first and second zipper profiles 44 and 46, respectively, coupled to top end 32 of bag 10. First and second zipper profiles, 44 and 46, respectively, each include a first vertical edge 48 and a second vertical edge 50. First vertical edges 48 are sealed to one another and second vertical edges 50 are sealed to one another, such as by an ultrasonic bonding process or a sealing material. In one embodiment, each zipper profile 44 and 46 includes a track and an attachment flange extending from the track. Zipper profiles 44 and 46 are releasably coupled to one another, and more particularly, the tracks of each zipper profile 44 and 46 are releasably coupled to one another. As such, bag 10 may be opened to access the product within bag 10 and closed again to restrict access to the product using zipper member 40.

In the example embodiment, zipper member 40 extends beyond the outer edges of front and rear walls 18 and 20. As such, each zipper profile 44 and 46 includes a first horizontal edge 52 and a second horizontal edge 54 that extend between the outermost portion of front and rear walls 18 and 20 and vertical edges 48 and 50. In an alternate embodiment, zipper member 40 extends for a length less than a width of front and rear walls 18 and 20. In the example embodiment, zipper member 40 is opened and closed using slider clip 42.

First zipper profile 44 is attached to front wall 18, and more particularly, an outer surface 56 of front wall 18. Second zipper profile 46 is attached to rear wall 20, and more particularly, an outer surface 58 of rear wall 20. Alternatively, zipper profiles 44 and 46 are attached to inner surfaces of bag 10. In the example embodiment, zipper profiles 44 and 46 are attached to bag 10 using an adhesive. Alternatively, zipper profiles 44 and 46 are attached to bag 10 using another securing means, such as, but not limited to, heat sealing or using a mechanical fastener.

In the example embodiment, bag 10 includes a plurality of end stops 60 for limiting a range of motion of slider clip 42 along zipper member 40. End stops 60 extend outward from an outer portion 62 of zipper member 40. In one embodiment, end stops 60 extend outward from each of first and second zipper profiles 44 and 46. Additionally, end stops 60 are positioned proximate each end of zipper member 40. End stops 60 extend outward a distance to contact slider clip 42 as slider clip 42 is moved along zipper member 40. In the example embodiment, end stops 60 are glue drops or glue beads applied to zipper member 40 during fabrication of bag 10.

Figure 3:
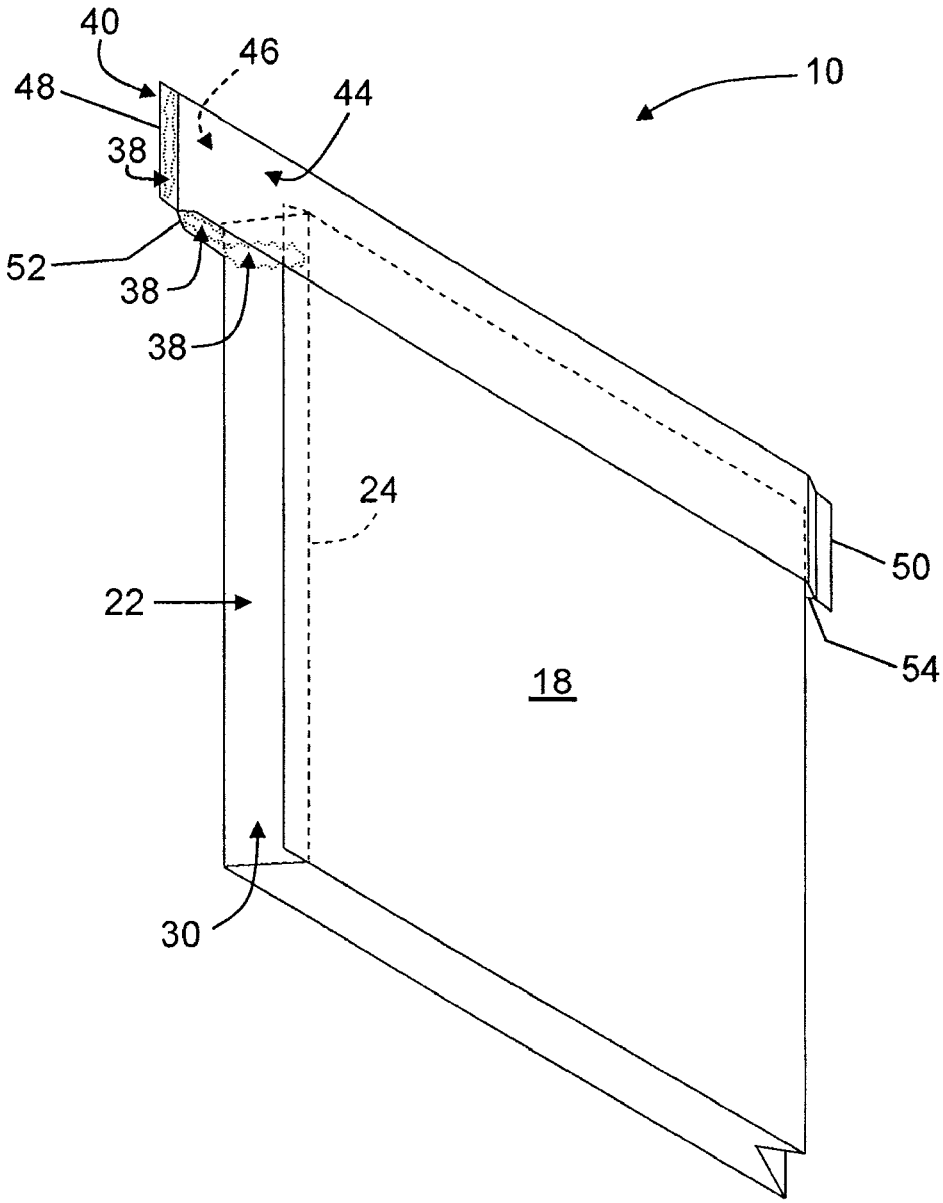
FIG. 3 is an enlarged side view of the multiwall bag shown in FIG. 2 in a closed position.
Figure 4:
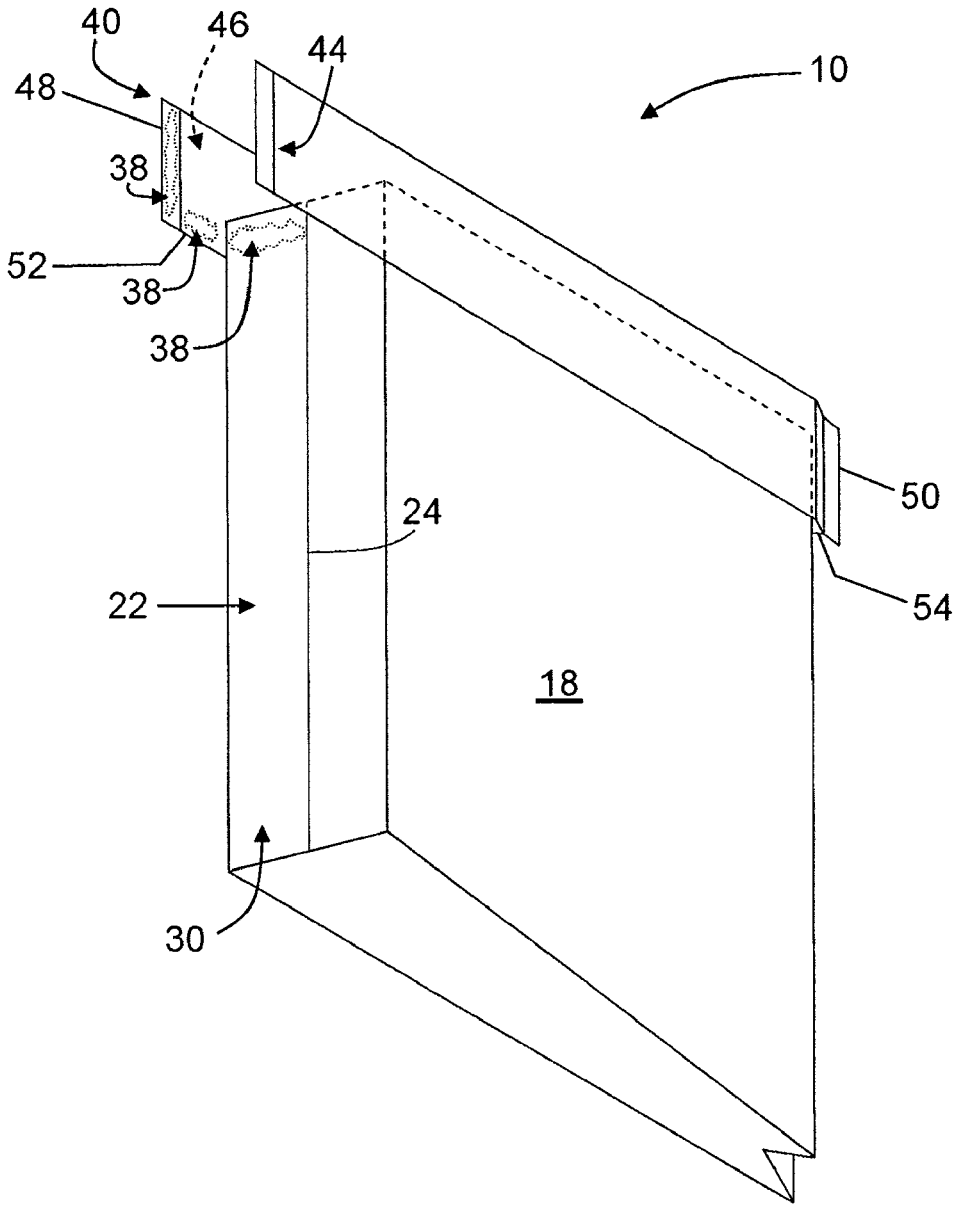
FIG. 4 is an enlarged side view of the multiwall bag shown in FIG. 2 in an open position.

FIG. 3 is an enlarged side view of bag 10 in a closed position, and FIG. 4 is an enlarged side view of bag 10 in an open position. In the example embodiment, sealing material 38 is applied to an area proximate to at least a top edge of an outer surface of first gusset panel 26 such that it extends from an outer edge of side wall 22 to center fold line 24. Alternatively, sealing material 38 is applied to both first and second gusset panels 26 and 28, respectively, such that it extends from an outer edge of side wall 22 to a point beyond center fold line 24. When sealing material 38 is applied in this manner and side wall 22 is folded along center fold line 24, channel 30 is completely sealed and thus reduces the risk of pests from entering bag 10 through channel 30.

Further, in the example embodiment, sealing material 38 is applied to an area proximate first and second vertical edges 48 and 50 of zipper member 40 as well as to an area proximate a portion of first and second horizontal edges 52 and 54 of zipper member 40 proximate to vertical edges 48 and 50. The sealing material 38 applied along horizontal edges 52 and 54 extends between first and second zipper profiles 44 and 46 from vertical edges 48 and 50 to a side edge of the bag body creating a seal therebetween. In the example embodiment, sealing material 38 applied along horizontal edges 52 and 54 is in direct contact with sealing material 38 applied along first gusset panel 26 so as to create a total seal from the outside environment when bag 10 is constructed. By creating this seal, the risk of small pests, such as mites, entering bag 10 from the outside environment through openings within the gusseted side walls between portions of the first and second zipper profiles 44 and 46 that extend outwardly from the bag body and through the end of the zipper member 40 is significantly reduced.

In the example embodiment, sealing material 38 is a resealable adhesive and is also used to seal the ends of zipper member 40 to one another. In this configuration, as is shown in FIG. 4, bag 10 may be opened such that at least one gusseted side wall 22 is fully extended allowing for top end 32 to open to a wider position for pouring or providing easier access to the contents of bag 10. In addition, the use of a resealable adhesive as sealing material 38 allows for bag 10 to be resealed by the application of pressure from the consumer's hand. As such, bag 10 may be stored until the contents are emptied with a significantly reduced risk of pests entering bag 10 and contaminating the contents thereof.

Figure 5:
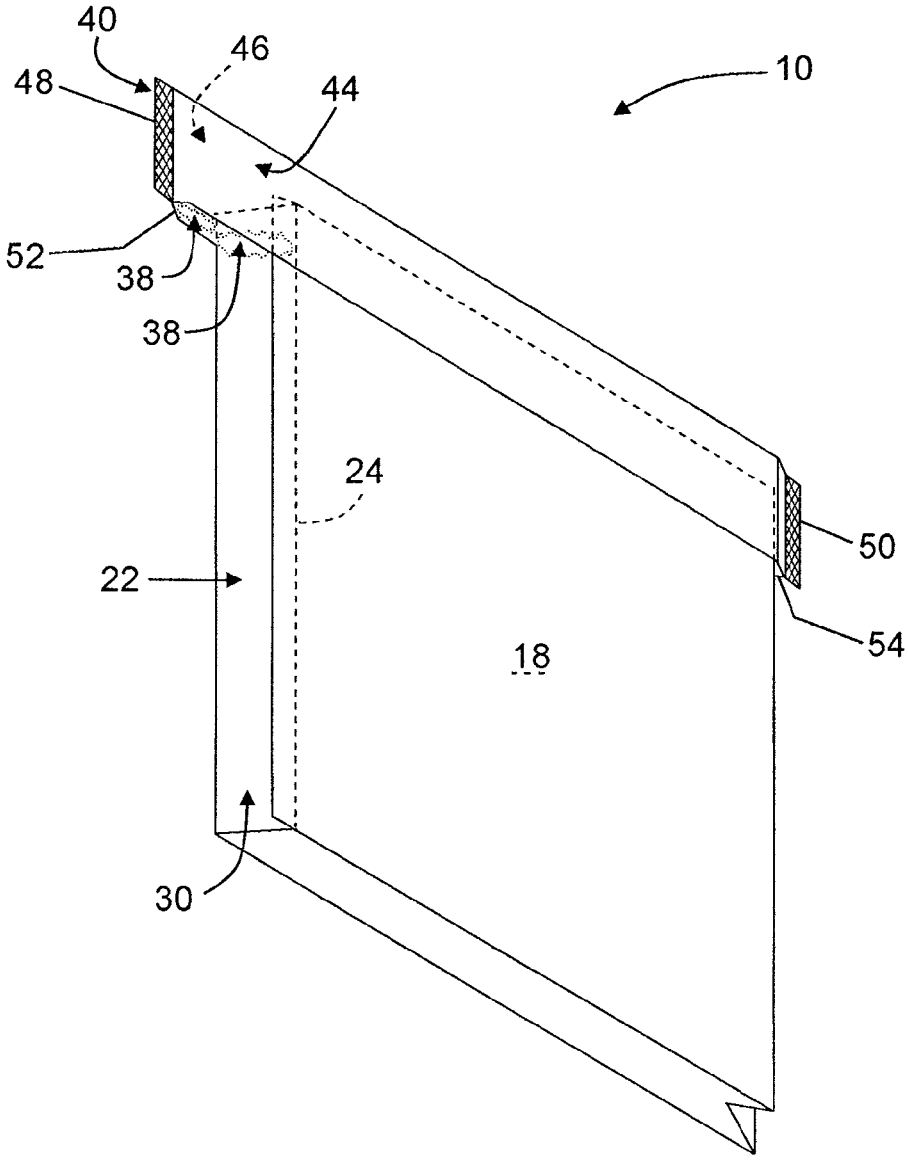
FIG. 5 is an enlarged side view of an alternative embodiment of the multiwall bag shown in FIG. 2 in a closed position.

FIG. 5 is an enlarged side view of an alternative embodiment of bag 10 in a closed position. In this embodiment, sealing material 38 is applied to an area proximate to at least a top edge of an outer surface of first gusset panel 26 such that it extends from an outer edge of side wall 22 to center fold line 24. Alternatively, sealing material 38 is applied to both first and second gusset panels 26 and 28, respectively, such that it extends from an outer edge of side wall 22 to a point beyond center fold line 24. When sealing material 38 is applied in this manner and side wall 22 is folded along center fold line 24, channel 30 is completely sealed and thus reduces the risk of pests from entering bag 10 through channel 30.

Further, in the alternative embodiment shown in FIG. 5, vertical edges 48 and 50 are heat sealed and sealing material 38 is applied to an area proximate a portion of first and second horizontal edges 52 and 54 of zipper member 40 proximate to vertical edges 48 and 50. The sealing material 38 applied along horizontal edges 52 and 54 extends between first and second zipper profiles 44 and 46 from vertical edges 48 and 50 to a side edge of the bag body creating a seal therebetween. In the example embodiment, sealing material 38 applied along edges horizontal 52 and 54 is in direct contact with sealing material 38 applied along first gusset panel 26 so as to create a total seal from the outside environment when bag 10 is constructed. By creating this seal, the risk of small pests, such as mites, entering bag 10 from the outside environment through openings within the gusseted side walls between portions of the first and second zipper profiles 44 and 46 that extend outwardly from the bag body and through the end of the zipper member 40 is significantly reduced.

Figure 6:
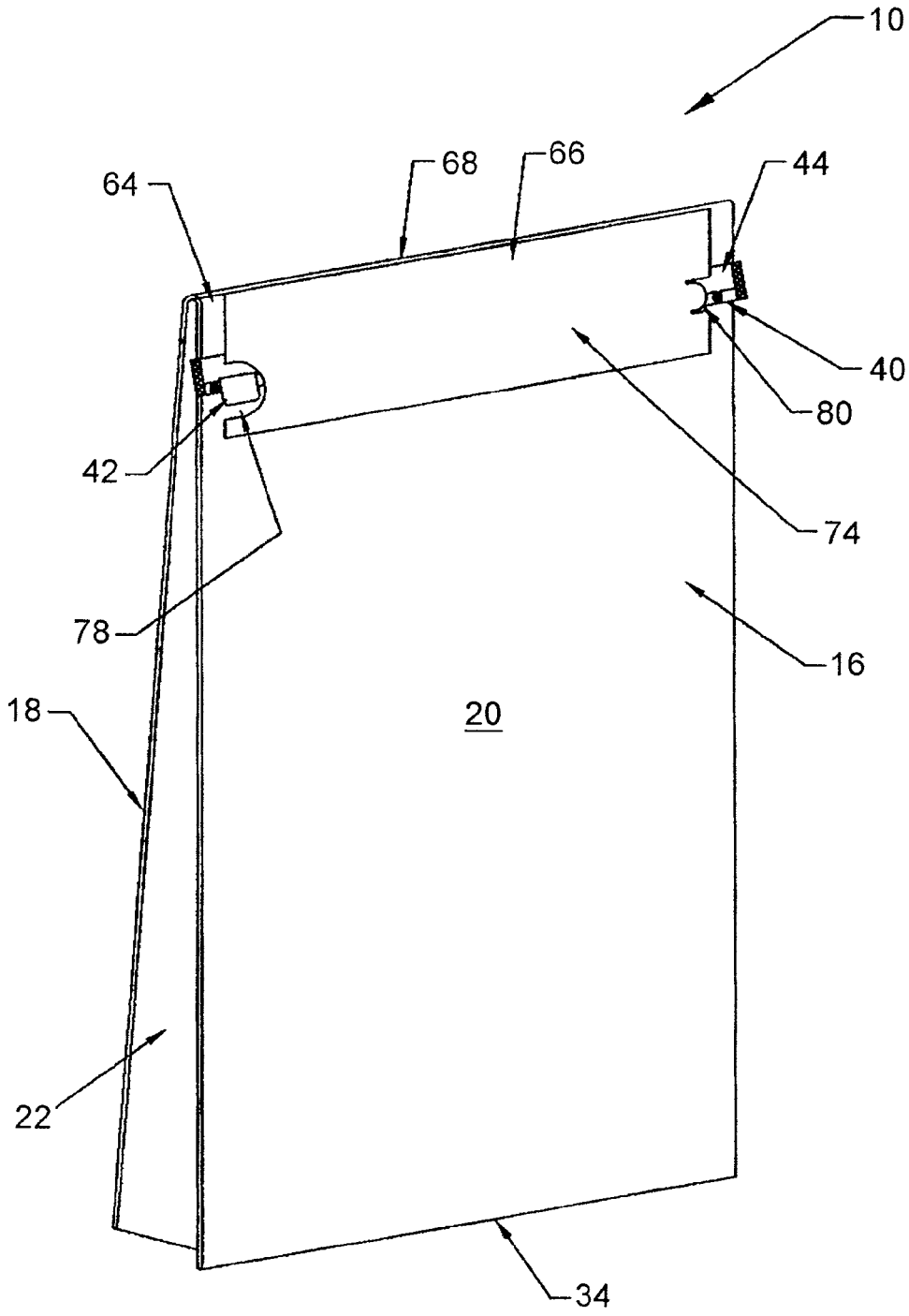
FIG. 6 is a side perspective view of the multiwall bag shown in FIG. 2 with a top portion of the bag folded over and an adhesive member affixed along the folded over portion.
Figure 7:
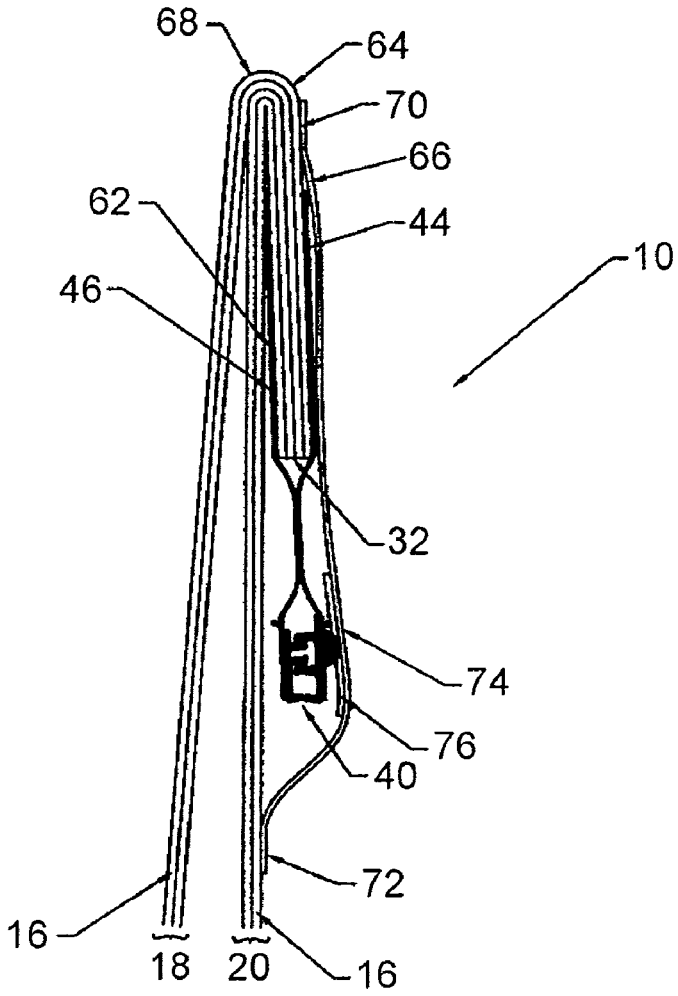
FIG. 7 is a cross sectional view of the multiwall bag shown in FIG. 4.

FIG. 6 is a side perspective view of bag 10 with a top portion or flap 64 of bag 10 folded over and secured using an adhesive member 66. FIG. 7 is a cross sectional view of bag 10 with top flap 64 folded over. During assembly, bag 10 is folded along a hinge or crease 68 to define top flap 64. Hinge 68 includes fold lines through each layer of material in bag 10 and is positioned proximate to top end 32 of bag 10 such that the overall volume of cavity 36 is as large as possible given the size of walls 18, 20, and 22. Additionally, hinge 68 is positioned a sufficient distance from top end 32 to provide an attachment area on bag 10 for adhesive member 66. As such, a strip of outer layer 16 of bag 10 is exposed between hinge 68 and zipper member 40, and adhesive member 66 is coupled to the strip of outer layer 16, as will be described in detail below. In the example embodiment, when top flap 64 is folded over, rear wall 20 is folded over upon itself such that the portion of rear wall 20 defining top flap 64 contacts or is positioned proximate to rear wall 20. Additionally, when top flap 64 is folded over, outer portion 62 of second zipper profile 46 (i.e., the zipper profile coupled to rear wall 20) contacts or is positioned proximate to rear wall 20. Alternatively, when top flap 64 is folded over, front wall 18 is folded over upon itself and zipper profile 46 is positioned proximate front wall 18.

In assembly, when top flap 64 is folded over, top flap 64 and bag 10 define a false top at hinge 68. More particularly, during loading of bag 10 through bottom end 34, the product is loaded to fill cavity 36 to hinge 68. As such, the product is restricted from contacting top end 32 of bag 10, and more importantly, zipper member 40. As such, impact forces on zipper member 40 are reduced and/or eliminated during the filling process of bag 10.

In the example embodiment, adhesive member 66 includes a first adhesive portion or band 70 and a second adhesive portion or band 72. First adhesive portion 70 secures adhesive member 66 to front wall 18 and/or first zipper profile 44. Second adhesive portion 72 secures adhesive member 66 to rear wall 20. As such, adhesive member 66 extends along first zipper profile 44 and secures top flap 64 in the folded over position. In the example embodiment, adhesive member 66 is secured to bag 10 such that adhesive member 66 has a substantially flat or planar configuration. Specifically, adhesive member 66 extends along the contour of bag 10 from top flap 64 towards bottom end 34 of bag 10 and does not wrap around or fold over or under top end 32 of bag 10.

Moreover, in the example embodiment, adhesive member 66 includes a reinforced section or tear strip 74. Reinforced section 74 extends between first and second adhesive portions 70 and 72, respectively. In the example embodiment, reinforced section 74 includes an area of reinforcement extending between first and second adhesive portions 70 and 72. In one embodiment, reinforced section 74 is reinforced with a plastic band 76 extending the length of reinforced section 74. In one embodiment, reinforced section 74 extends substantially the entire length of adhesive member 66. In another embodiment, adhesive member 66 includes a notched out portion 78 at an edge of adhesive member 66 and aligned with reinforced section 74. In the example embodiment, slider clip 42 is positioned within notched out portion 78 and is restricted from moving along zipper member 40 until reinforced section 74 is removed.

In use, severing of adhesive member 66 releases top flap 64 and allows access to zipper member 40 and the contents of bag 10. Specifically, severing of adhesive member 66 may be accomplished by removing reinforced section 74. Additionally, removal of reinforced section 74 allows slider clip 42 to move along zipper member 40. In the example embodiment, adhesive member 66 includes a pull tab 80 connected to one end of reinforced section 74. Pull tab 80 facilitates severing of reinforced section 74 along the area of reinforcement. Specifically, pull tab 80 is configured to separate at least a portion of reinforced section 74 from first and second adhesive portions 70 and 72.

Figure 8:
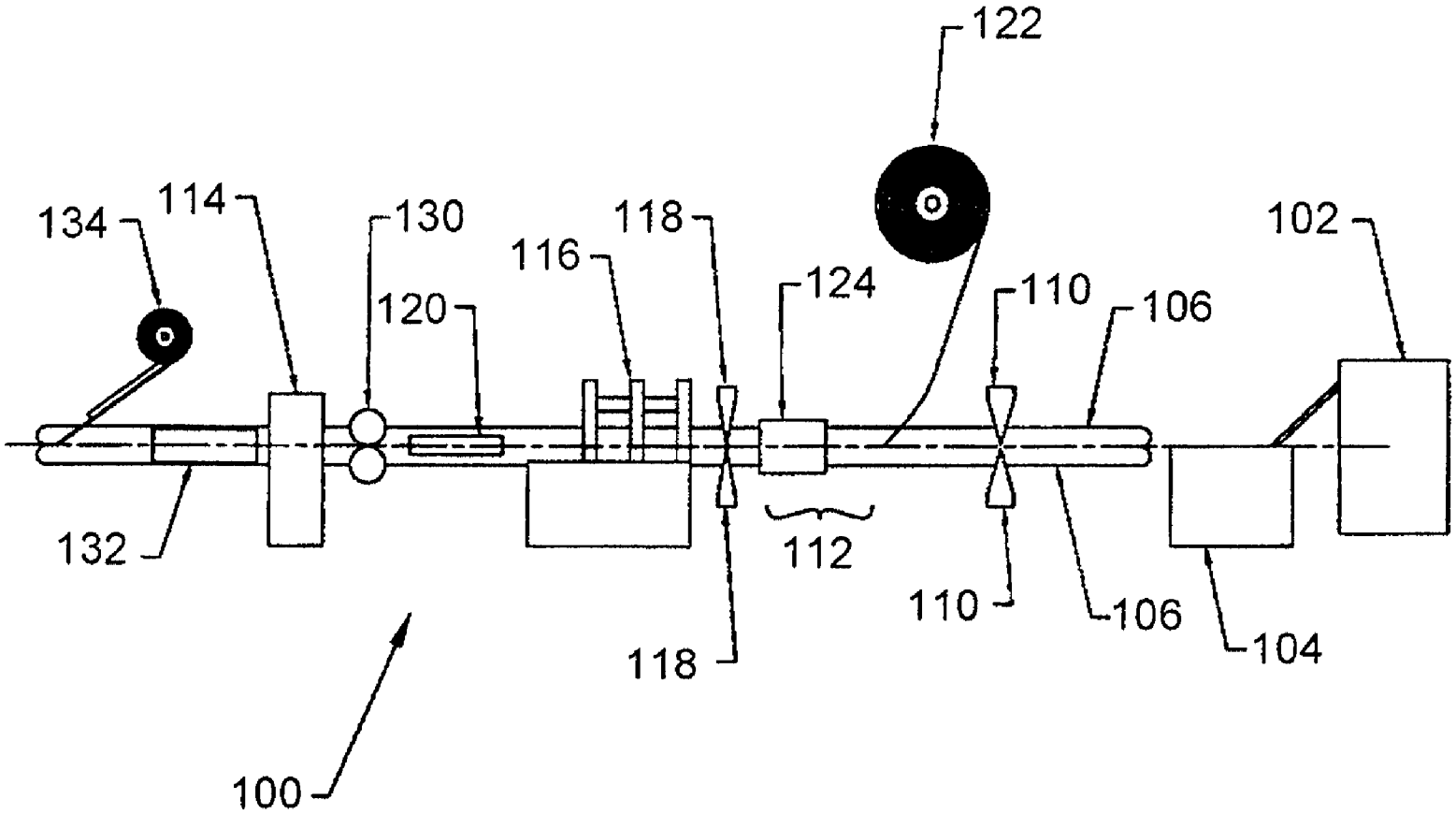
FIG. 8 is a schematic view of a forming machine that may be used to manufacture the multiwall bag shown in FIGS. 1-6.

FIG. 8 is a schematic view of a forming machine 100 that may be used to form bag 10 (shown in FIGS. 1-6). Forming machine 100 includes a plurality of components used to form bag 10. In one embodiment, the components are generally grouped into three forming phases, a positioning or set-up phase; a zipper/slider application or intermediate phase; and a folding or finishing phase.

In the example embodiment, forming machine 100 includes a bag feeder 102, a registration table 104, and transporting members 106. Components 102, 104, and 106 are utilized in the positioning phase. Specifically, bag feeder 102 houses multiple, preformed tubular multiwall bags 10. Feeder 102 feeds individual bags 10 onto registration table 104. Registration table 104 aligns and positions bags 10 squarely and consistently as bags 10 are transferred downstream to the remaining components of forming machine 100. Specifically, registration table 104 aligns each bag 10 parallel to each other bag 10 and aligns top ends 32 (shown in FIG. 1) of bags 10. As such, top ends 32 of bags 10 are positioned to receive zipper members 40 (shown in FIG. 2). As bags 10 are accepted onto registration table 104, bags 10 are consistently spaced from a trailing edge of one bag 10 to a leading edge of another bag 10 (i.e., a consistent spacing between side walls 22 of adjacent bags 10). Additionally, transporting members 106 cooperate with registration table 104 for aligning, securing and transporting bags 10 and maintaining the relative positions of bags 10. In one embodiment, transporting members 106 include belts, such as conveyor type belts, that are positioned on opposing sides of and engaging bags 10, thus securing bags 10 therebetween. Also, transporting members 106 facilitate transferring bags 10 downstream to the remaining components of forming machine 100.

Moreover, in the example embodiment, forming machine 100 includes a first adhesive applicator 110, a slider applicator system 112, and a cutter 114. In one embodiment, forming machine also includes a zipper member sealing system 116, a second adhesive applicator 118, and a venturi 120. Components 110120 are utilized in the zipper/slider application phase.

Bags 10 are transferred to first adhesive applicator 110 by transporting members 106. As bags 10 are transferred past applicator 110, adhesive is applied to bag 10. In one embodiment, adhesive is applied to front and rear walls 18 and 20 (shown in FIG. 1) proximate top end 32 of bag 10. In one embodiment, adhesive is applied as a continuous bead. In another embodiment, adhesive is applied as individual bead drops. Bags 10 are then transferred to slider applicator system 112.

Slider applicator system 112 includes a zipper applicator 122 and a slider applicator 124. Zipper applicator 122 attaches zipper member 40 to bags 10, and slider applicator 124 attaches slider clips 42 to zipper member 40. Alternatively, slider clips 42 are attached to zipper member 40 and the zipper/slider combination is attached as a unit to bags 10. In the example embodiment, zipper member 40 is attached as a continuous web to bags 10 as bags 10 are transferred past slider applicator system 112. In one embodiment, the flanges of first and second zipper profiles 44 and 46 are adhered or otherwise secured to the adhesive beads applied to bags 10 by first adhesive applicator 110. Alternatively, the adhesive beads are applied directly to zipper member 40 prior to joining zipper member 40 to bag 10. In another alternative embodiment, zipper member 40 includes a hot melt portion such that zipper member 40 is attached to bag 10 upon application of heat to zipper member 40. In the example embodiment, after zipper member 40 is attached to bags 10, slider clip 42 is coupled to the tracks of zipper member 40.

Machine 100 further includes a sealing material application device. The sealing material application device applies sealing material 38 to an area proximate to at least one of a top edge of an outer surface of first gusset panel 26 such that sealing material 38 extends only from an outer edge of side wall 22 to center fold line 24. In an alternative embodiment, the sealing material application device applies sealing material 38 to both first and second gusset panels 26 and 28, respectively, such that sealing material 38 extends from an outer edge of side wall 22 to a point beyond center fold line 24. The sealing material application device further applies sealing material 38 to an area proximate first and second vertical edges 48 and 50 of zipper member 40 as well as to an area proximate first and second horizontal edges 52 and 54 of zipper member 40. By applying a proper amount of sealing material 38 only within channel 30 created by side walls 22 and between first and second zipper profiles 44 and 46, leakage or exuding of sealing material 38 to the outside of bag 10 where it is visible to a consumer is prevented.

In the example embodiment, bags 10 are transferred from slider applicator system 112 to zipper member sealing system 116. Sealing system 116 seals the flanges of first and second zipper profiles 44 and 46 to one another to form end portions of zipper member 40. In one embodiment, sealing system 116 is an ultrasonic sealer. In one embodiment, sealing system 116 includes an actuator configured to move multiple sealing units with bags 10. As a result, multiple bags 10 may be sealed simultaneously.

In the example embodiment, bags 10 are transferred from slider applicator system 112 to second adhesive applicator 118. Second adhesive applicator 118 applies beads of adhesive to the outer portion of first and second zipper profiles 44 and 46. The beads of adhesive, or glue drops, function as end stops for slider clip 42. Additionally, in the example embodiment, forming machine 100 includes venturi 120. Venturi 120 directs airflow to the glue drops to facilitate quick cooling of the glue drops as bags 10 are transferred downstream. In an alternative embodiment, rather than second adhesive applicator 118, forming machine includes an alternative end stop applicator.

In the example embodiment, bags 10 are transferred downstream of slider applicator system 112 to cutter 114. As indicated above, zipper member 40 is applied to bags 10 as a continuous web. Therefore, zipper member 40 extends between and connects the individual bags 10 to one another. Cutter 114 facilitates cutting zipper member 40 between bags 10 such that bags 10 are no longer connected to one another.

Moreover, in the example embodiment, forming machine 100 includes a creasing member 130, a folding station 132, and an adhesive member applicator 134. Components 130-134 are utilized in the folding phase. In the example embodiment, creasing member 130 includes a wheel having a wedge shaped edge. Creasing member 130 forms fold lines in bag 10 which ultimately define hinge 68 (shown in FIG. 6). In one embodiment, creasing member 130 is utilized to crease bags 10 prior to bags 10 being cut by cutter 114.

Bags are transferred from creasing member 130 to folding station 132. At folding station 132, top flap 64 (shown in FIG. 6) is folded over at hinge 68 created by creasing member 130. In the example embodiment, folding station 132 includes a plurality of rails that engage top flap 64 of bag 10 and fold top flap about hinge 68. The rails also secure top flap 64 in a folded over position as bags 10 are transferred to adhesive member applicator 134.

Adhesive member applicator 134 houses a web of adhesive members 66. As bags 10 are transferred past adhesive member applicator 134, the individual adhesive members 66 are attached to bags 10 proximate top flap 64. Specifically, adhesive members 66 are attached to both front and rear walls 18 and 20 of bag 10 and extend along first zipper profile 44 (shown in FIG. 6). As a result, adhesive members 66 secure top flaps 64 in the folded over position.

A multiwall bag and a machine for forming the multiwall bag are described above in detail. The multiwall bag includes a zipper member and a slider for opening and closing the zipper member. The multiwall bag further includes a sealing material applied along a top portion of the gusseted side wall and between the zipper profiles of the zipper member. As a result, the multiwall bag is sealed at its natural ingress channels or openings, which prevents small pests or other insects to enter the bag and contaminate the contents thereof. Additionally, when a resealable material is used, the bag is able to be resealed from the outside environment with the pressure of one's hand. The multiwall bag is configured for bottom loading of a product, and during loading, the top end of the multiwall bag is subject to impact forces. As a result, the multiwall bag is designed such that the top end of the bag is folded over. An adhesive member is attached to the top flap to retain the top flap in a folded over position. The adhesive member extends along one side of the zipper profile and is secured to both the front and rear walls. With adhesive member applied and the top flap folded over, the impact forces from loading of the multiwall bag are substantially reduced and/or eliminated. To access the contents of the multiwall bag, the adhesive member is severed by removing the reinforced section extending through the adhesive member. Additionally, the adhesive member functions as a tamper evident member. As a result, a multiwall bag is provided in a cost effective and reliable manner.

As is described herein, the bag structure includes a bag body that has at least one outer layer of paper material and at least one inner layer of polymeric material, side walls having inner and outer surfaces, a top end, and a bottom end. The side walls include a front wall and an opposed rear wall, and a closure member is attached to the front and rear walls. The closure member includes a zipper member coupled to the top end and extending substantially an entire length of the top end, a slider clip for opening and closing the bag body, and end stops, or glue drops, that extend outwardly from the closure member proximate the outer edges of the closure member such that the slider clip is movable between the end stops. The bag structure also includes a sealing material applied to an area proximate at least one of a top edge of the side walls and a bottom edge of a portion of the closure member. The bag structure further includes an adhesive member that is secured to the bag body and that includes a reinforced section and an adhesive section. The adhesive section is configured to retain the top end of the bag body in a folded over relationship until the adhesive member is severed along the reinforced section. The adhesive section extends substantially an entire length of the top end of the bag body and includes a first adhesive portion secured to a first side wall and a second adhesive portion secured to a second side wall that is generally opposed to the first side wall. The adhesive member has a substantially flat configuration. The reinforced section of the adhesive member includes a pull tab configured to separate at least a portion of the reinforced section from the adhesive section. The bag body is configured such that when the top end of the bag body is folded over, an outer portion of the closure member that is attached to the rear wall abuts the outer surface of the rear wall a distance from the top end of the bag body wherein the adhesive member extends along an outer portion of the closure member attached to the front wall. The front, rear, and side walls further include complementary fold lines that extend substantially parallel to and spaced apart from the top end to define a top flap. The top flap is configured to be folded over and defines a false top for the bag such that when the bag is bottom loaded with a product, the product contacts the false top defined by the fold lines during loading of the product and the top flap restricts the product from contacting the top end of the bag until the adhesive member is severed.

A method is also provided for assembling a bag structure having front, rear, and side walls that extend between top and bottom ends of the bag structure; a zipper member; a slider clip; and an adhesive member having an adhesive section that includes a first and second adhesive portion and a reinforced section. The method includes attaching the zipper member to the top end of the bag structure, attaching the slider clip to the zipper member wherein the slider clip is configured to open and close the zipper member, applying a sealing material to an area proximate at least one of a top edge of the side walls and a bottom edge of a portion of the zipper member, folding over the top end of the bag structure along a fold line to define a top flap that defines a false top for the bag structure at the fold line, and securing the top flap to an outer surface of the bag structure using the adhesive member, wherein the top flap is released upon severing the adhesive member at the reinforced section. Securing the top flap to an outer surface of the bag structure includes adhering the first adhesive portion to the front wall, extending the adhesive member along the closure member, and adhering the second adhesive portion to the rear wall. The method further includes orienting the bottom end of the bag structure for bottom loading with a product such that when the product is loaded into the bag structure, the product contacts the false top and is restricted from contacting the zipper member. In addition, the method includes forming first and second end stops on an outer portion of the zipper member proximate outer edges of the zipper member such that the slider clip is moveable between the end stops.

Exemplary embodiments of a multiwall bag are described above in detail. The bag is not limited to the specific embodiments described herein, but rather, components of each bag may be utilized independently and separately from other components described herein. Each bag component can also be used in combination with other bag components.

While the invention has been described in terms of various specific embodiments, those skilled in the art will recognize that the invention can be practiced with modification within the spirit and scope of the claims.

What is claimed is:

1. A bag comprising:

a generally tubular body having a top end, a front wall, a rear wall, and side walls;

the front wall having a top edge, an inner surface, and an outer surface;

the rear wall having a top edge, and inner surface, and an outer surface;

each of the side walls having an outer surface, a top edge, and a longitudinally extending fold line defining gusset panels that, when the bag is closed, substantially overlie each other at the top edge of each side wall;

a first zipper profile secured to the front wall extending along the top edge thereof;

a second zipper profile secured to the rear wall extending along the top edge thereof;

a slider clip on the first and second zipper profiles for decoupling the zipper profiles to open the bag when slid in one direction and coupling the zipper profiles to close the bag when slid in the opposite direction; and a gusset sealing material disposed between the gusset panels at the top edge of each side wall when the bag is closed to inhibit leakage and ingress by pests, wherein the first and second zipper profiles have ends and wherein corresponding ends of the first and second zipper profiles project beyond the top edges of the front and rear wall respectively to define tabs on at least one side of the bag, the tabs being secured together by a resealable sealing material.

2. A bag as claimed in claim 1 and wherein the gusset sealing material is a resealable adhesive that separates when the bag is opened and can be resealed when the bag is closed again.

3. A bag as claimed in claim 1 and wherein the first and second zipper profiles are secured to the outside surfaces of the front and rear walls respectively.

4. A bag as claimed in claim 3 and wherein each tab has a horizontal edge and a vertical edge.

5. A bag as claimed in claim 4 wherein the tabs are secured together along their horizontal edges.

6. A bag as claimed in claim 5 and wherein the resealable sealing material is contiguous with the gusset sealing material.

7. A bag as claimed in claim 4 and wherein the tabs are secured together along their vertical edges.

8. A bag as claimed in claim 1 and wherein the bag is folded over on itself along the top end of the body forming a flap.

9. A bag as claimed in claim 8 and further comprising an adhesive member secured to the bag and the flap to hold the flap in its folded over configuration.

10. A bag as claimed in claim 9 and further comprising a tear strip extending along the adhesive member and positioned to sever the adhesive member when pulled to permit the flap to be unfolded for opening up the bag.

11. A bag comprising:

first and second side walls each having a top edge;

first and second end walls connecting the first and second side walls and having top edges;

the first end wall having a longitudinally extending fold line that defines first and second inwardly foldable gusset panels of the first end wall;

a resealable opener extending along the top edges of the first and second side walls for selectively opening up and closing the bag; and a gusset sealing material disposed between the gusset panels adjacent the top edge of the first end wall to seal the bag against spillage and pest infiltration at the upper corner of the bag when closed, wherein the resealable opener comprises a zipper member that opens the bag when operated in one direction and closes the bag when operated in the opposite direction, wherein the zipper member comprises a first zipper profile attached to and extending along the top edge of the first side wall and a second zipper profile attached to and extending along the top edge of the second side wall, wherein the first and second zipper profiles extend beyond the top edges of the first and second side walls on at least one end to define tabs, and wherein the tabs are secured together with a resealable adhesive so that the tabs can be separated when the bag is open and resealed when the bag is closed.

12. The bag of claim 11 and wherein the zipper member has a slider clip that opens the bag when slid in the one direction and closes the bag when slid in the opposite direction.

13. The bag of claim 11 and wherein the first and second side walls have outer surfaces and wherein the first and second zipper profiles are attached to the outer surfaces of the first and second side walls respectively.

14. The bag of claim 11 and wherein the tabs each have a first edge substantially parallel to the top edges of the first and second side walls and a second edge substantially perpendicular to the top edges of the first and second side walls.

15. The bag of claim 14 and wherein the tabs are secured together along their second edges.

16. The bag of claim 14 and wherein the tabs are secured together along their first edges.

17. The bag of claim 16 and wherein the resealable adhesive is contiguous with the gusset sealing material.

18. The bag of claim 11 and wherein the first and second side walls are folded over along a crease proximate the top edges of the first and second side walls to form a flap and further comprising an adhesive member securing the flap to the bag in its folded-over configuration.

19. The bag of claim 18 and further comprising a tear strip extending along the adhesive member for separating the adhesive member to allow the bag to be opened.

* * * * *